US010584012B2

(12) United States Patent
Nilsson et al.

(10) Patent No.: US 10,584,012 B2
(45) Date of Patent: Mar. 10, 2020

(54) TWO-PART AND STACKABLE CABLE SPOOL ARRANGEMENT

(71) Applicant: Axjo Plastic Aktiebolag, Gislaved (SE)

(72) Inventors: Jacob Nilsson, Anderstorp (SE); Anders Gaardsdal, Gislaved (SE); Rickard Strömberg, Grimsås (SE)

(73) Assignee: AXJO PLASTIC AKTIEBOLAG, Gislaved (SE)

( * ) Notice: Subject to any disclaimer, the term of this patent is extended or adjusted under 35 U.S.C. 154(b) by 43 days.

(21) Appl. No.: 15/916,767

(22) Filed: Mar. 9, 2018

(65) Prior Publication Data

US 2019/0276266 A1 Sep. 12, 2019

(51) Int. Cl.
*B65H 75/22* (2006.01)
*B65H 75/14* (2006.01)

(52) U.S. Cl.
CPC ..... *B65H 75/22* (2013.01); *B65H 75/14* (2013.01); *B65H 2701/534* (2013.01)

(58) Field of Classification Search
CPC ... B65H 75/14; B65H 75/22; B65H 2701/534
USPC ..... 242/608.6, 609.1
See application file for complete search history.

(56) References Cited

U.S. PATENT DOCUMENTS 3,176,932 A * 4/1965 Kovaleski ..... B65D 85/04 242/118.41
3,642,223 A * 2/1972 Feichtinger ..... B65H 75/14 242/609.1
2008/0230648 A1 9/2008 Hafner
2014/0312159 A1 10/2014 Troitzsch et al.

FOREIGN PATENT DOCUMENTS

| | | | | |
|---|---|---|---|---|
| DE | 42 02 218 C2 | | 7/1993 | |
| DE | 29517593 U1 | * | 12/1995 | ..... B65H 75/14 |
| DE | 19700185 A1 | * | 7/1998 | ..... B65H 75/22 |
| DE | 10025730 A1 | | 12/2001 | |
| DE | 20 2008 005 926 U1 | | 8/2008 | |
| DE | 202013101355 U1 | * | 4/2013 | ..... B65H 75/14 |
| WO | 2006/094787 A1 | | 9/2006 | |
| WO | 2012098001 A2 | | 7/2012 | |

OTHER PUBLICATIONS

Machine Translation of DE 295 17 593 U1, Dec. 21, 1995. (Year: 1995).*

(Continued)

*Primary Examiner* — William E Dondero

(74) *Attorney, Agent, or Firm* — Buchanan Ingersoll & Rooney P.C.

(57) ABSTRACT

The present invention relates to a cable spool arrangement for use in automated cable winding applications, said cable spool arrangement comprising a first core half and a second core half, each one of the first and second core halves comprising an outer wall having a conical section, wherein each one of said first core half and said second core half comprises a connecting arrangement configured to connect said first core half and said second core half together, and comprising at least one protrusion and at least one recess. The present invention also relates to a stackable cable spool half.

10 Claims, 7 Drawing Sheets

(56) References Cited

OTHER PUBLICATIONS

Machine Translation of DE 20 2013 101 355 U1, Jun. 6, 2013. (Year: 2013).*
Machine Translation of DE 197 00 185 Al, Jul. 9, 1998. (Year: 1998).*
Extended European Search Report dated Jul. 25, 2019, issued by the European Patent Office in corresponding European Application No. 19161031.0-1017, (8 pages).

* cited by examiner 219
217
217b
209b
267
209
263
217a
2
209a
215
223
211
221
213
221
217b
207
2
223
223
203
209a
201
209
221
223
221
205
260
217
261
265

TWO-PART AND STACKABLE CABLE SPOOL ARRANGEMENT

TECHNICAL FIELD OF THE INVENTION

The present inventive concept relates to the field of two-part cable spools and cable spool arrangements for use in automated cable winding applications.

BACKGROUND OF THE INVENTION

Different kinds of cable spools are being used for carrying and transporting various types of cables and wires, such as electric cables, fiber optic cables and wire products. Cable spools can be made of e.g. wood, plywood, steel and plastic.

It is known that two-part and stackable cable spools have several benefits over single-piece cable spools. For example, being stackable means that the storage space needed and the transportation volume of the spools are decreased, thus reducing logistic costs for the user. Just like single-piece cable spools, two-part cable spool may be used in automated, high speed cable winding applications.

Plastic cable spools may be produced in many different manners, e.g. by producing parts that are thereafter joined together. In order to provide for a stronger and more durable product, it is desirable to produce as much as possible of the product in one piece.

When winding cables onto such two-part cable spools using automated, high speed cable wiring applications, a common problem is that there is a risk that the two halves of the cable spool might disengage from each other. This is often due to the fact that in some prior art solutions, the connecting arrangement between the two halves wears down over extended use. As the halves are connected, disconnected and reconnected again over multiple iterations, the connecting arrangement loses some of its ability to lock the two halves to each other. Thus, a solution that decreases the risk of the cable spool halves accidentally separating is desirable.

SUMMARY OF THE INVENTION

An object of the inventive concept is to overcome the above problems, and to provide cable spool arrangement which, at least to some extent, is less complex than prior art solutions. This, and other objects, which will become apparent in the following, are accomplished by means of a cable spool arrangement and a cable spool half as defined in the accompanying claims.

The present inventive concept is based on the insight that a cable spool arrangement can be made less complex and easier for the user to handle with a connecting arrangement comprising protrusions and corresponding recesses in combination with a snap-lock.

According to a first aspect of the present inventive concept, a cable spool arrangement for use in automated cable winding applications is provided. The cable spool arrangement comprises:

a first core half and a second core half, each one of the first and second core halves comprising an outer wall having a conical section, wherein each one of said first core half and said second core half comprises a connecting arrangement configured to connect said first core half and said second core half together, and comprising at least one protrusion and at least one recess, wherein the protrusion of the connecting arrangement of said first core half is sized and dimensioned to mate with the corresponding recess of the connecting arrangement of said second core half to form a first protrusion-recess pair, and said recess of the connecting arrangement of said first core half is sized and dimensioned to mate with the corresponding protrusion of the connecting arrangement of said second core half to form a second protrusion-recess pair, and wherein said connecting arrangements comprises a snap-lock configured to axially lock said first core half to said second core half when the respective protrusion is received in the respective recess.

Hereby, a cable spool arrangement is provided which is easy to put together and to install. The cable spool arrangement is also safe to use when exposed to rough treatment, for example during winding or unwinding of cable, without the risk of having the cable spool falling apart. This is because each one of the two core halves is provided with a connecting arrangement comprising protrusions and recesses that are sized and dimensioned to mate with the corresponding protrusions and recesses of a matching cable core half, and that each connecting arrangement comprises at least one snap-lock. This means that each core half of the cable spool arrangement is provided with a single connecting arrangement with two locking functions. The protrusions and the recesses, which are configured to mate with each other, give the cable spool a rotational stability. In addition, the snap-lock provides a safe and secure locking in both a rotational and an axial direction.

The connecting arrangement is easy to handle for the user since it requires only one movement for locking, i.e. to push the core halves together in an axial direction. No rotational movement is needed to lock the two core halves together. The two core halves are then locked in relation to each other in both an axial and in a rotational direction.

In cases where the cable spool arrangement is heavy or has large dimensions, it is preferable to be able to lock the core halves together in one step. In addition, the cable spool is, in its assembled state, both stable and safe to use since the connecting arrangements with their protrusions and corresponding recesses, in combination with the snap-locks, prevent unintentional unlocking of the two core halves in either rotational or axial direction. This will be described in greater detail below.

When two core halves of the cable spool arrangement are connected to each other, a cable spool is formed. The cable spool arrangement could consist of more than two parts, e.g. two core halves and two flanges connectable to each one of the core halves. Alternatively, the cable spool could be made of two parts, e.g. two core halves each having an integrated flange. Such components may be referred to as cable spool halves. It should be understood that a spool may alternatively be referred to as a coil, a reel, or a drum, depending on its size, dimensions and intended use. In the context of the inventive concept, a cable may alternatively refer to other types of filamentous material such as wire, rope, tape, or other winding material. Furthermore, recesses may alternatively be referred to as depressions or cavities. In the following, the terms cable spool halves and core halves are used interchangeably.

It should be understood that one of the purposes of the connecting arrangement is to provide a cable spool that is difficult to separate after assembly, i.e. to prevent unintended reuse of the core halves or cable spool halves which may result in quality issues with the connecting arrangements. Decoupling and recoupling the connecting arrangements of two core halves or cable spool halves may result in the connecting arrangements losing some of their ability to securely lock the two core halve or cable spool halves together. Thus, a connecting arrangement allowing decoupling and subsequent recoupling of the core halves or cable spool halves to each other is undesirable. In at least one example embodiment of the present invention, this is solved by the fact that the snap-lock, once the two cable spool halves are connected to each other, is arranged internally of the cable spool, e.g. on the protrusions and/or in the recesses.

According to at least one example embodiment, said connecting arrangements of said first and second core halves are configured to, by a single axial movement of the first core half towards the second core half, both rotationally and axially lock said first core half to said second core half.

This provides an advantage when it comes to fast and simple locking of the two cable spool halves to each other. The fast and simple locking is achieved by making a protrusion of the first core half fit into a recess of the second core half, and then moving the two cable spool halves towards each other. Once the protrusions are received by the recesses, the snap-lock is activated and the function of the connecting arrangement is achieved.

In preparation of connecting the two core halves to each other, one of the core halves may need to be rotated to align the protrusions and recesses of the first core half with the recesses and protrusions of the second core half, i.e. aligning the connecting arrangement of the first core half with the connecting arrangement of the second core half. However, this rotation is regarded as an adjustment in preparation for locking the core halves together, and not a locking step in itself. Once the core halves are aligned, the single axial movement of the first core half towards the second core half is sufficient for rotationally and axially locking the core halves together.

In one example embodiment each connecting arrangement comprises a plurality of protrusions and a plurality of recesses. In such embodiments, the rotational movement needed to make the connecting arrangement of the two halves align with each other is less than in embodiments where each connecting arrangement has a single protrusion and a single recess. According to one example embodiment, the protrusions of each one of the two connecting arrangements are identical to each other, and/or the protrusions of the two connecting arrangements are identically distributed over the circumference of each one of the core halves. According to one example embodiment, the recesses of each one of the two connecting arrangements are identical to each other and/or the recesses of the two connecting arrangements are identically distributed over the circumference of each one of the core halves.

According to one example embodiment, each one of the protrusions of each connecting arrangement has an associated recess on the same connecting arrangement, with each such protrusion being located closer to its associated recess than to the other adjacent recesses. On each connecting arrangement, the protrusions and their associated recesses may be equidistantly distributed over circumference of each one of the core halves. A protrusion and its associated recess may be referred to as a protrusion-recess couple.

According to at least one example embodiment, each one of the recesses of the connecting arrangements is sized and dimensioned to enclose the respective protrusion of the connecting arrangements, to enable rotational locking of the two core halves relative to each other.

Hereby, the cable spool halves may be connected to each other without requiring any rotational locking movement, while still being protected from accidental disengagement when exposed to high rotational forces during usage, e.g. in winding operations.

In the context of the present inventive concept, enclose is to be understood as meaning that each protrusion is surrounded by side walls of the recess. For example, the side walls of the protrusion may be in direct contact with the side walls of the recess in at least two directions, or preferably at least four directions. Alternatively, the walls of the protrusion may be adjacent to the walls of the recess in at least two directions, or preferably at least four directions.

According to at least one example embodiment, each one of the protrusions of the connecting arrangements comprises a section which is tapered in an axial direction away from the center of the core half. Hereby, the protrusions may be wedged into the corresponding recess, and may thus provide an improved coupling of the core halves.

Additionally or alternatively, each one of the protrusions of the connecting arrangements comprises an elongated rib arranged in the axial direction of the respective protrusion. Such ribs provide for better connection between the protrusion and the corresponding recess.

According to at least one example embodiment, each one of said first core half and said second core half comprises a first end portion comprising said connecting arrangement, and a second end portion connectable to a cable spool flange, wherein said respective conical section tapers from said respective second end portion towards said respective first end portion.

According to at least one example embodiment, said conical section has a tapering angle of 2-10° relative to a longitudinal axis of each cable spool half, preferably between 2-8°, and most preferable between 2-6°.

According to at least one example embodiment, each one of said cable spool halves has a flange diameter of 200-1400 mm, preferable between 400-800 mm, and most preferable between 400-600 mm.

According to at least one example embodiment, each one of said core halves has a diameter at the first end thereof of 100-500 mm, preferable between 150-350 mm, and most preferable between 150-200 mm.

According to at least one example embodiment, each one of said core halves has a diameter at the second end thereof of 100-600 mm, preferable between 200-500 mm, and most preferable between 200-300 mm.

Such structure entails a good stacking possibility of the core halves, and allows for the first core half to be stacked inside of said second core half. Moreover, different flanges could be selected for different intended end uses. The diameter of the flanges may determine the maximum amount of cable rolled up on the cable spool. The larger the diameter of the flanges, the more cable may be rolled up or alternatively, the thicker cable may be rolled up.

Furthermore, different flanges could be chosen for different requirements of stability. For example, a flange manufactured of plastic material of high quality may be used for heavy cable spools.

The conical shape of the core halves gives the cable spool arrangement, in its unassembled state, a possibility to be stacked. According to at least one example embodiment, the conical section for each one of the two core halves extends from the respective first end portion to the respective second end portion. In other words, each one of the core halves is tapering from said respective second end portion to said respective first end portion. Furthermore, when the core halves of cone-shaped configuration are stacked on top of each other, the connecting arrangement which is situated on the first end portion is protected from impacts. The stackability of core halves which have no flanges attached thereto is more efficient, i.e. the packing ratio of the core halves separate from the flanges is greater than the packing ratio of stacked cable spool halves that have flanges attached thereto.

In at least one example embodiment, the at least one protrusion and at least one recess of the connecting arrangement of said first core half are comprised in said first end portion of said first core half, and the at least one protrusion and at least one recess of the connecting arrangement of said second core half are comprised in said first end portion of said second core half.

According to at least one example embodiment, said first end portion of each one of said first core half and said second core half comprises an end portion surface from which said at least one protrusion is extending axially outwardly, and from which said at least one recess is extending axially inwardly.

Inwardly is to be understood as being in a direction from said first end portion and towards said second end portion, while outwardly is to be understood as being in a direction from said first end portion and away from said second end portion.

According to one example embodiment, the two connecting arrangements are identical. Preferably, each one of the core halves comprises the same number, the same size and type, and the same arrangement of protrusions and recesses in order to match one another.

Furthermore, the fact that the protrusions and recesses are situated on the end portion surface of the core halves has the advantage that easy access to the connecting arrangement is prevented when the cable spool arrangement is in its assembled state and the two core halves are connected to each other. Thus, the connecting arrangement is protected from outer mechanical stress and tampering, thus making unintended reuse of the cable spool arrangement more difficult.

According to at least one example embodiment, said snap-lock comprises male snap-lock parts and female snap-lock parts, and wherein each one of said first and second protrusion-recess pairs comprises a pair of at least one male snap-lock part and at least one female snap-lock part.

This means that the snap-lock is protected from outer stress when the cable spool arrangement is in its assembled state, since the snap-locks are then located inwardly of the end portion surfaces of each one of the core halves. In addition, once the cable spool arrangement is assembled, significant efforts are required for a person to disengage the two core halves from each other. Thus, the snap-locks being located inwardly of the end portion surfaces makes it preferable to break the cable spool in order to disengage the two halves from each other. In other words, a benefit of the present invention is that disengagement of the two core halves from each other is made difficult by the placement and design of the connecting arrangement, thus causing a user wishing to recycle a cable spool formed by the cable spool arrangement of the present invention to rather break the two cable spool halves apart and thereby destroying the connecting arrangement than to attempt to disconnect the two cable spool halves from each other without damaging the connecting arrangement. Thus, unintended reuse of the cable spool arrangement is prevented.

Moreover, by providing the protrusions and the recess with the snap-lock, an efficient way to provide means for simultaneously axially and rotationally lock the two core halves together is provided.

According to at least one example embodiment, the cable spool is arrangeable in an assembled state in which the first core half is connected to said second core half by that said first and second protrusion-recess pairs are mating, and is arrangeable in an unassembled state in which the first core half is separated from said second core half, and wherein said first core half and said second core half are, in said unassembled state, configured to be stackable, such that at least a part of said conical section of said first core half is received within said conical section of said second core half.

The core halves being stackable is space saving, and thus lowers the cost of logistics for a user of the cable spool arrangement. Hereby, the volume of the core halves in an unassembled state is reduced and the cost-efficiency of the transportation of the core halves from manufacturer to user may be improved.

In a preferred example embodiment, the first end portion of the first core half, comprising the connecting arrangement, may be received within the conical section of the second core half. This means the connecting arrangement of the first core half is protected in an empty space enclosed by the outer wall of the second core half. Since the connecting arrangement comprises both a protrusion-recess pair and a snap-lock mechanism, all these features of the first core half are protected in an empty space enclosed by the outer wall of the second core half when the core halves are stacked together.

According to at least one example embodiment, each one of said first core half and said second core half comprises an inner wall having an inner wall outer surface, such that an interior core space is formed in each core half between an inner surface of said outer wall and said outer surface of said inner wall. The inner wall is to be understood as being located inside a space at least partly defined by said outer wall.

Hereby, the cable spool is made up of two separate walls. The outer wall defines the outer shape of the cable spool while the inner wall or inner tube defines the inner shape. Since the interior core space is not solid, the cable spool halves can be stacked together. By having an inner wall, the stability of the cable spool arrangement is increased. This is an advantage in cases where for example plastic material of lower quality is used, as is the case with many types of recycled plastic materials. In addition, the inner tube makes it possible to decrease the inner diameter of the assembled cable spool such that there is no need for a diameter reducing end-cap to be attached thereto. In other words, the core halves are double layered and the outer wall serves as the carrier for the winding material.

According to at least one example embodiment a cable spool arrangement is provided, wherein the inner wall of each one of the first and second core halves tapers in a direction opposite to the outer wall of the respective conical section.

According to at least one example embodiment, a spacer is arranged in said interior core space, said spacer being configured to prevent said first core half from wedging with said second core half during stacking of the first and second core halves.

According to at least one example embodiment, a spacer is arranged in said interior core space of each one of the core halves, said spacer being configured to keep the inner surface of the outer wall of one core half apart from the outer surface of the outer wall of the other core half. In other words, the two surfaces are prevented from being in contact with each other while simultaneously extending in substantially the same geometrical plane.

The advantage that the spacer provides is that a large number of core halves can be stacked upon each other without jamming or wedging of the halves. Such stacking of core halves makes it possible to reduce transport volume and the storage space needed. Furthermore, the spacer makes it possible to obtain a volume of open space between two adjacent core halves in the stacked arrangement thereof. This open space between two core halves is enclosed by the outer surface of the inner wall of the first core half and the inner surface of the outer wall of the second core half. Since the connecting arrangements of the core halves are configured with the protrusions and snap-lock being located at the end portion surfaces, the connecting arrangement of one core half is enclosed by a surrounding core half when the core halves are stacked, i.e. the connecting arrangement of one core half is held inside the open space between two core halves.

According to at least one example embodiment, the connecting arrangements of the first core half and the second core half are identical.

Having identical connecting arrangements means that there is no need to match a connecting arrangement of a first type with connecting arrangements of a second type when assembling the cable spool arrangement into a cable spool. Hereby, the cable spool arrangement is easy and cheap to manufacture since the two cable spool halves may be made identical. Identical is to be understood as meaning for example that the two core halves may have the same proportions between the flanges and the diameter of the conical part adjacent to the flanges, the same proportions of the outer wall to the inner wall, having the same length of the core portion and having the same diameter of the core portions. It could also mean that the number, size and/or dimensions of protrusions and recesses are equal. There could be either an even number or an odd number of protrusions and recesses, but the amount of recesses on one core half should be equal to the amount protrusions on that core half.

According to at least one example embodiment, the two core halves are not identical and differ in either length, tapering angle, flange diameter, or other aspects. However, the connecting arrangements of the two core halves are identical as described above, in order for the core halves to be connectable to each other.

According to a second aspect of the present invention, a stackable cable spool half is provided, comprising:

- a first end portion comprising a connecting arrangement,
- a second end portion being connectable to a flange,
- a conical section arranged between said first and second end portions, wherein said connecting arrangement comprises at least one protrusion and at least one recess configured to connect said cable spool half to a corresponding connecting arrangement of another cable spool half, wherein the protrusion and the recess of the connecting arrangement are sized and dimensioned to mate with each other, and wherein said protrusion comprises one of a male snap-lock part and a female snap-lock part, and said recess comprises the other one of said male snap-lock part and female snap-lock part, said male and female snap-lock parts being sized and dimensioned to mate with each other.

According to at least one example embodiment, said first end portion comprises an end portion surface from which said at least one protrusion is extending axially outwardly, and from which said at least one recess is extending axially inwardly.

According to at least one example embodiment, said cable spool half further comprises an inner wall having an inner wall outer surface, such that an interior core space is formed between an inner surface of said outer wall and said outer surface of said inner wall.

According to at least one example embodiment, a spacer is arranged in said interior core space, said spacer being configured to prevent said cable spool half from wedging with another cable spool half during stacking of the cable spool half of the present invention and the other cable spool half.

The stackable cable spool half according to the second aspect of the present invention may be used in an arrangement according to the different embodiments of the first aspect of the present invention. The advantages, and embodiments, described above for any of these features are also valid for the second aspect of the present invention.

According to a third aspect of the present invention, a method is provided for producing a cable spool arrangement, said method comprising the step of:

- forming a first cable spool core half and a second cable spool core half, wherein each cable spool core half comprises:
  - a first end portion comprising a connecting arrangement,
  - a second end portion being connectable to a flange,
  - a conical section arranged between said first and second end portions, wherein said connecting arrangement comprises at least one protrusion and at least one recess configured to connect said cable spool half to a corresponding connecting arrangement of another cable spool half, wherein the protrusion and the recess of the connecting arrangement are sized and dimensioned to mate with each other, and wherein said protrusion comprises one of a male snap-lock part and a female snap-lock part, and said recess comprises the other one of said male snap-lock part and female snap-lock part, said male and female snap-lock parts being sized and dimensioned to mate with each other.

The method according to the third aspect of the present invention may be used to produce a cable spool arrangement according to the different embodiments of the first aspect of the present invention and/or to create two a stackable cable spool halves according to the different embodiments of the second aspect of the present invention. The advantages described above for any of these features are also valid for the third aspect of the present invention.

According to a fourth aspect of the present invention, a method for assembling two core halves to form a cable spool is provided, said method comprising the steps of:

- providing a cable spool arrangement according to the first aspect of the present invention,
- coaxially aligning the two cable spool halves of the cable spool arrangement so that the protrusions of one cable spool half faces the recesses of the other cable spool half,
- moving the two cable spool halves towards each other, such that the protrusions of either cable spool half are received by the recesses of the other cable spool half and the snap-lock of each cable spool half engages with the snap-lock of the other cable spool half.

Thus, an easy, quick and reliable way of connecting two cable spool halves is achieved. The method above has the benefit of both rotationally and axially locking two cable spool halves to each other with only a single axial movement being necessary, once the cable spool halves have been aligned. Commonly available cable spool arrangements require at least an axial and a rotational movement for achieving a similar locking effect.

BRIEF DESCRIPTION OF THE DRAWINGS

The above, as well as additional objects, features and advantages of the present invention, will be better understood through the following illustrative and non-limiting detailed description of exemplary embodiments of the present invention, with reference to the appended drawing, wherein.

DETAILED DESCRIPTION OF THE DRAWINGS

Figure 1:
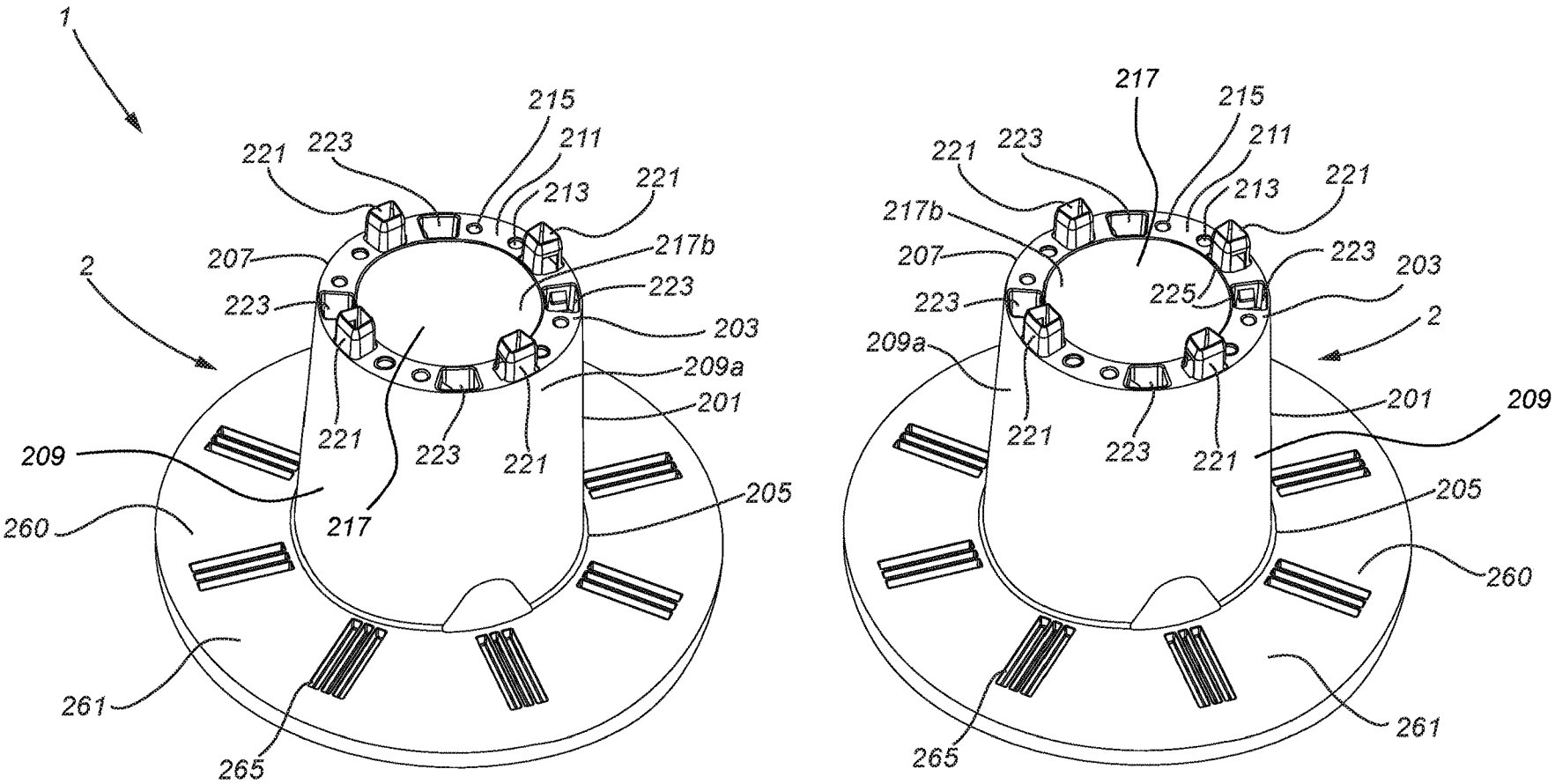
FIG. 1 is a perspective view of an unassembled cable spool arrangement according to one exemplary embodiment of the first aspect of the present invention.

In the present detailed description, embodiments of a cable spool arrangement 1 according to the present invention are mainly discussed with reference to drawings showing a cable spool arrangement 1 with components and portions being relevant in relation to various embodiments of the invention. It should be noted that this by no means limits the scope of the invention, which is also applicable in other circumstances for instance with other types or variants of cable spool arrangements 1 than the embodiments shown in the appended drawings. Further, that specific features are mentioned in connection to an embodiment of the invention does not mean that those components cannot be used to an advantage together with other embodiments of the invention.

In the following, any reference to the direction inwards is to be understood as meaning in a direction from a flange 260 or a second end of a cable spool half 2 and towards the connecting arrangement 207 of said cable spool half 2. Furthermore, any reference to the direction radially inwards is to be understood as meaning in a direction towards the longitudinal axis of the cable spool halves 2. Conversely, any reference to the directions outwards and radially outwards are to be understood in this context.

The invention will now by way of example be described in more detail by means of embodiments and with reference to the accompanying drawings.

FIG. 1 is a perspective view of an unassembled cable spool arrangement 1 according to one exemplary embodiment of the first aspect of the present invention. Shown here are two cable spool halves 2, each comprising a conically shaped core half 201 and a flange 260 formed integrally with the core half 201. The flange 260 allows the retention of cable wound upon the cable spool 3 formed by two cable spool halves 2 having been connected to each other. The flanges 260, having gripable portions and visual identification marks, allow the cable spool 3 and the cable spool halves 2 to be handled by automated machinery.

Each core half 201 has a first end 203 and a second end 205, and the flange 260 extends from the second end 205 of the core half 201, said second end 205 being the end adjacent to a base portion of the conical core half 201. The flange 260 extends in a plane that is perpendicular to the longitudinal extension of the core half 201, which longitudinal extension extends in the axial direction of the core half 201 and may thus be referred to as axial extension. In other words, the core half 201 tapers inwards from the flange 260 towards the first end 203, at which end a connecting arrangement 207 is provided. The flanges 260 of each cable spool half 2 have an inward facing side 261, and an outward facing side 263. On the inward facing side 261, each flange 260 is provided with reinforcing ribs 265 extending in a radial direction thereof, and on the outward facing side 263, each flange 260 is provided with further reinforcing ribs 267. These ribs 265, 267 allow for an increased stiffness and stability of the flanges 260.

Additionally, each one of the core halves 201 comprises a core half outer wall 209, upon the outer surface 209*a* of which the cable is to be spun or wound. The core half outer wall 209 is the wall forming the outer lateral surface area of the conically shaped core half 201, and the core half outer wall 209 extends in a longitudinal or axial direction between the first end 203 and the second end 205 of the core half 201.

At the first end 203 of the core half 201, extending in a plane that is substantially perpendicular to the longitudinal direction of the core half 201, is an annular end portion surface 211. The annular end portion surface 211 extends from the core half outer wall 209, in a radially inwards direction towards the longitudinal axis of the core half 201. On this annular end portion surface 211, a connecting arrangement 207 is provided. Additionally, there are provided holes 213 and indentations 215 on the annular end portion surface 211. The indentations 215 are where the gates or injections points in the injection molding process are located, and both the indentations 215 and the holes 213 are arranged to prevent gate mark defects from the injection molding process from interfering with another cable spool half 2 with which the cable spool half 2 is to be connected.

Extending from the annular end portion surface 211 of the core half 201 is a conically shaped core half inner wall 217. The core half inner wall 217 tapers outwards such that its diameter at the first end 203 of the core half 201 is greater than at the second end 205 thereof. In other words, the inner and outer walls 209, 217 of each core half 201 taper in opposite directions. The inner wall 217 comprises an outer surface 217*a* and an inner surface 217*b*, with the outer surface 217*a* being the surface facing in a radially outwards direction. Furthermore, the outer wall 209 comprises an outer surface 209*a* and an inner surface 209*b*, with the outer surface 209*a* being the surface facing in a radially outwards direction. Thus, the cable spool halves 2 are stackable, with the first end 203 of one core half 201 fitting inside an interior core space 219 formed between the inner surface 209*b* of the outer wall 209 and the outer surface 217*a* of the inner wall 217 of another core half 201. This interior core space 219 is illustrated in more detail in FIG. 2.

The connecting arrangement 207 is provided on the first end 203 of each core half 201 and is configured to mate with the connecting arrangement 207 of the other core half 201. The connecting arrangement 207 comprises a number of protrusions 221 and a number of recesses 223. In the illustrated embodiment, there are four protrusions 221 and four recesses 223, each recess 223 being arranged to receive and enclose the protrusions 221 of the other core half 201 and vice versa. In the illustrated embodiment, the protrusions 221 are equidistantly distributed about the circumference of the first end 203 of the core half 201 and protrude in a direction that is substantially parallel with a longitudinal axis of the core half 201. Similarity, the recesses 223 are also equidistantly distributed about the circumference of the first end 203 of the core half 201 and recede in a direction that is substantially parallel with a longitudinal axis of the core half 201. The protrusions 221 and recesses 223 are alternatingly distributed about the circumference of the core half 201, such that every protrusion 221 is located between two recesses 223 and every recess 223 is located between two protrusions 221. Furthermore, each protrusion 221 is located closer to one of its two adjacent recesses 223 than to the other. In other words, in one and the same connecting arrangement 207, there are provided a number of protrusion-recess couples 225. In the illustrated embodiment, each protrusion-recess couple 225 is identical to the others. Thus, there are four correct rotational positions in which the cable spool halves 2 may be connected to each other in the illustrated embodiment. Furthermore, the aforementioned holes 213 on the annular end portion 211 of each core half 201 may be used in an automated process for rotationally aligning two cable spool halves 2 with each other. In other, non-illustrated embodiments, the cable spool halves 2 may be provided with means for visually indicating a single correct rotational position. Such visually indicating means may for example be located on the flange 260 of each cable spool half 2.

Figure 2:
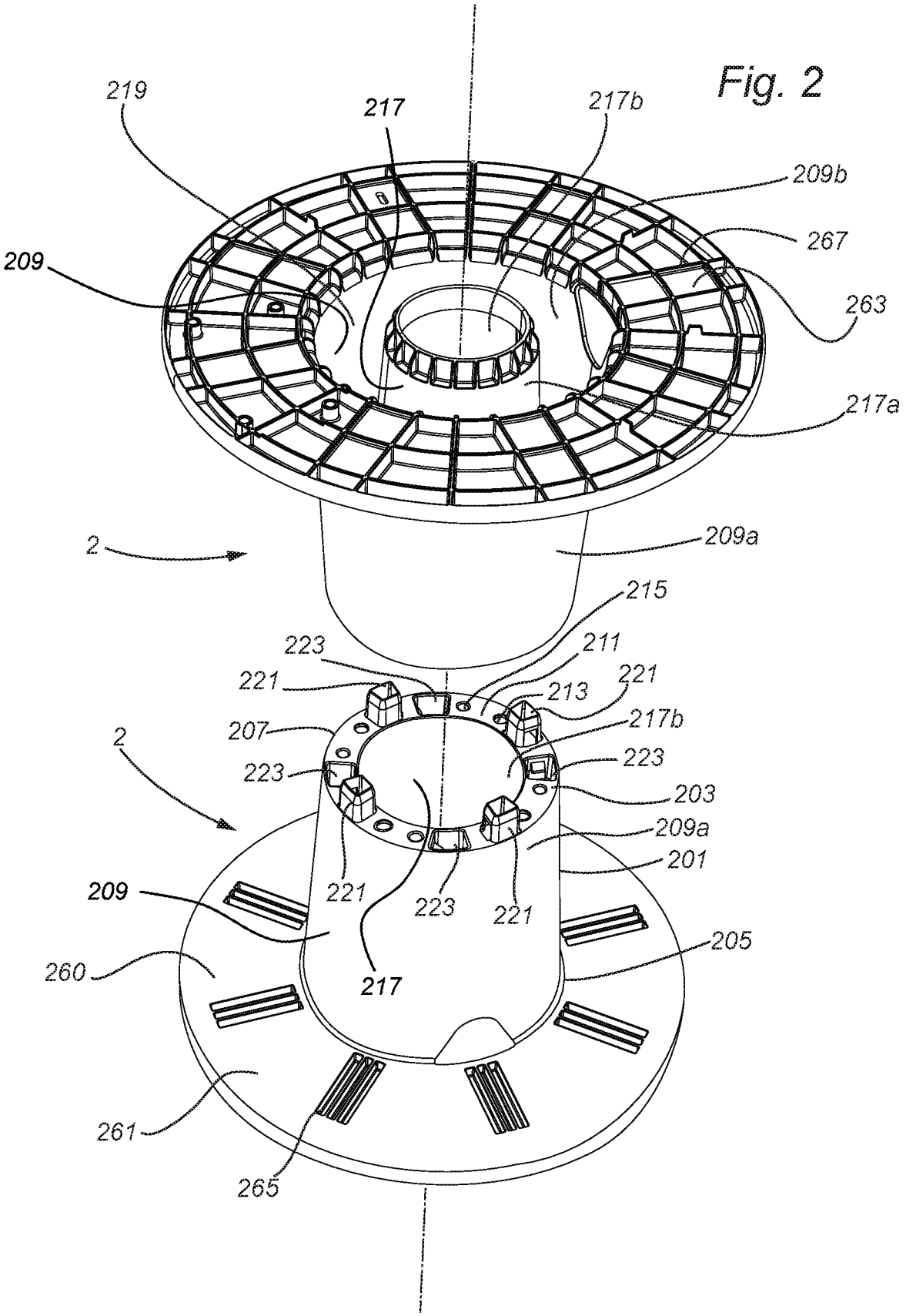
FIG. 2 is a perspective view of the cable spool arrangement of FIG. 1 being prepared for assembly.

FIG. 2 is a perspective view of the cable spool arrangement 1 of FIG. 1 being prepared for assembly. Here, two cable spool halves 2 are arranged opposite each other, in a position from which a single movement in a direction that is parallel with the longitudinal axes of the two cable spool halves 2 is such that the connecting arrangements 207 of each cable spool half 2 connects with that of the other. The connecting arrangement 207 is shown in more detail in FIG. 3.

Figure 3:
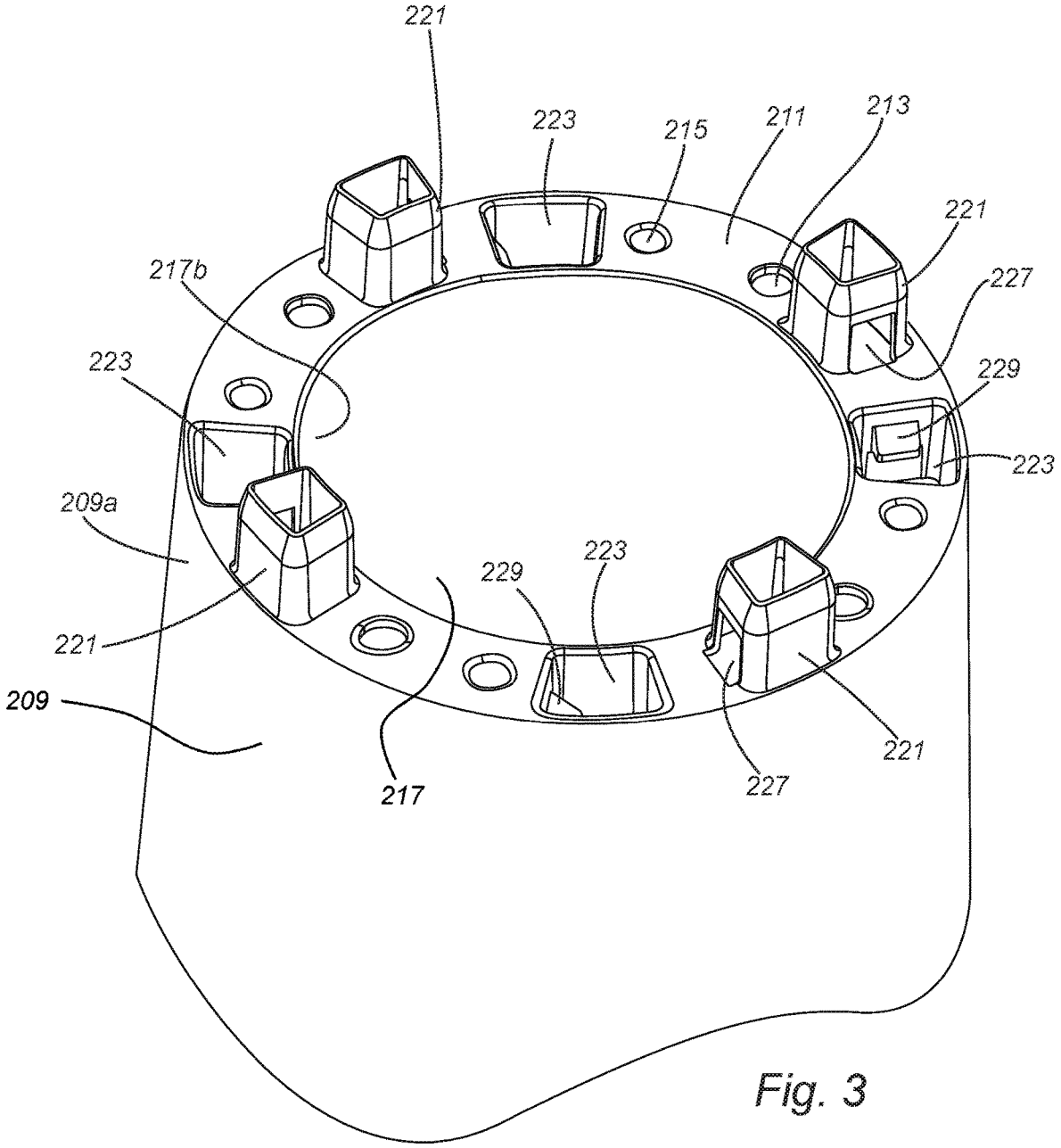
FIG. 3 is a detailed view of the connecting arrangement.

FIG. 3 is a detailed view of the connecting arrangement 207. Shown herein is the connecting arrangement 207 of one cable spool half 2. The protrusions 221 are shaped as slightly tapered rectangular cuboids having two sides facing in a radially inwards and radially outwards direction, respectively, and two sides facing in a respective circumferential direction of the cable spool half 2. Each protrusion 221 has a female snap-lock member 227 which is arranged to cooperate with a male snap-lock member 229 of the connecting arrangement 207 of another cable spool half 2.

The recesses 223 have a shape and dimension that corresponds to the shape and dimension of the protrusions 221, such that a protrusion 221 received by a recess 223 is enclosed therein on at least four sides thereof. Each recess 223 is also provided with a male snap-lock member 229, arranged to lock the protrusions 221 in place inside the recesses 223. The female snap-lock member 227 is an opening on a side wall of the protrusions 221. The male snap-lock member 229 is a wedge-shaped flexible protrusion extending from a side wall of the recesses 223. The male snap-lock member 229 is wedge-shaped such that it may engage with a female snap-lock member 227 in response to the protrusion 221 being fully received by the recess 223. Once engaged, the protrusion 221 may not leave the recess 223 without disengaging the male and female snap-locks 227, 229.

Figure 4:
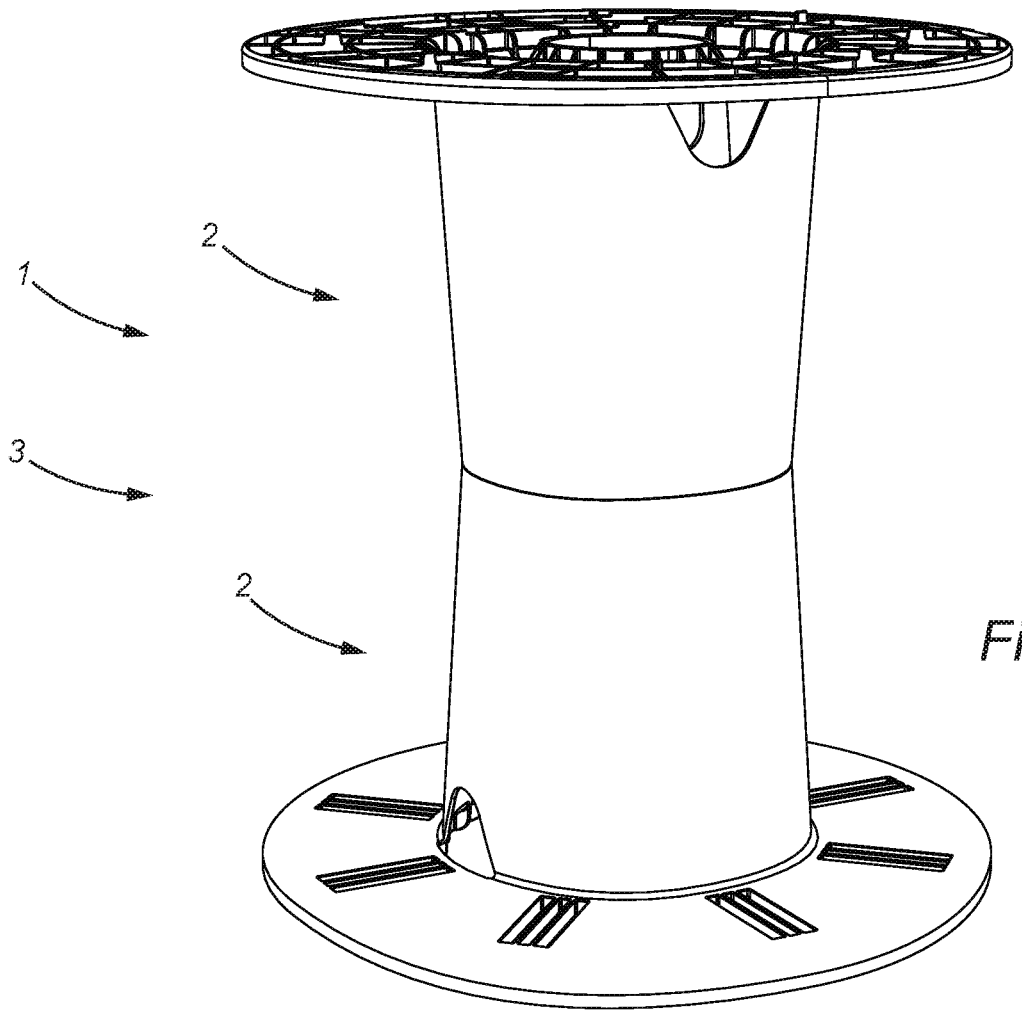
FIG. 4 is a perspective view of the cable spool arrangement of FIG. 1 in an assembled state.

From FIGS. 3 and 4, it is clear that the snap-lock 227, 229 provided on the protrusions 221 and recesses 223 of the connecting arrangement 207 is located such that the engagement therebetween occurs substantially internally of one of the two cable spool halves 2 which are to be connected to each other. Thus, the snap-lock 227, 229 is protected from external interference when two cable spool halves 2 are connected. Furthermore, the snap-lock 227, 229 is located on respective side walls of the protrusions 221 and recesses 223 that face in a circumferential direction of the connecting arrangement 207. Alternatively, the snap-lock 227, 229 may be located on respective side walls of the protrusions 221 and recesses 223 that face in a radial direction of the connecting arrangement 207. A radially facing snap-lock 227, 229 provides better engagement of the two cable spool halves 2, but takes up more space than a circumferentially facing snap-lock 227, 229.

FIG. 4 is a perspective view of the cable spool arrangement 1 of FIG. 1 in an assembled state. Here, a cable spool 3 is formed by the two cable spool halves 2 of the cable spool arrangement 1 being connected to each other. Also seen herein is the fact that the connecting arrangements 207 of the cable spool halves 2 are not readily accessible once the cable spool arrangement 1 is assembled.

Figure 5:
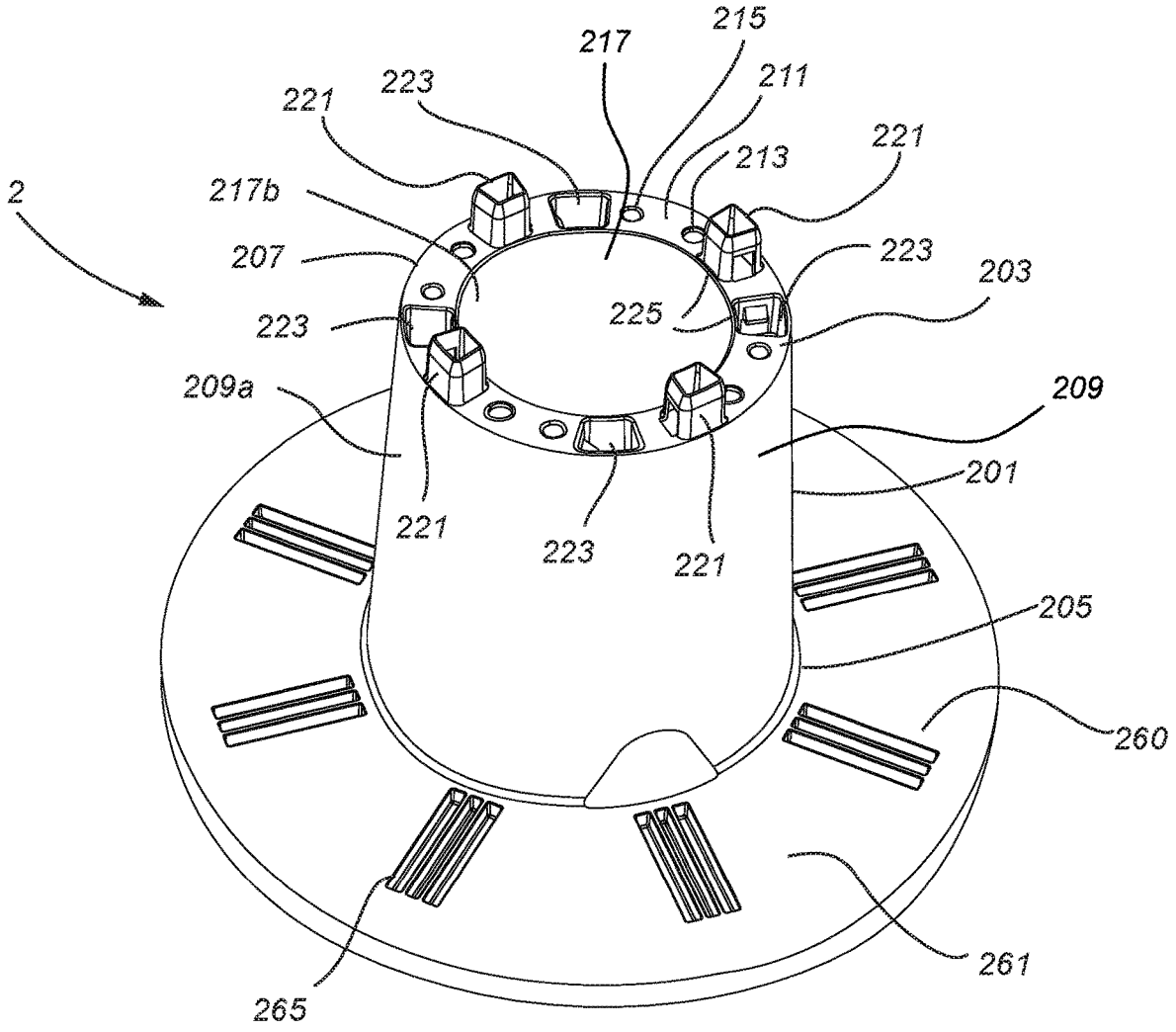
FIG. 5 is perspective view of a stackable cable spool half according to one exemplary embodiment of the second aspect of the present invention.

FIG. 5 is perspective view of a stackable cable spool half 2 according to one exemplary embodiment of the second aspect of the present invention. The description of the cable spool halves 2 given in view of the preceding figures applies for the stackable cable spool half 2 shown in FIG. 5 as well.

Figure 6:
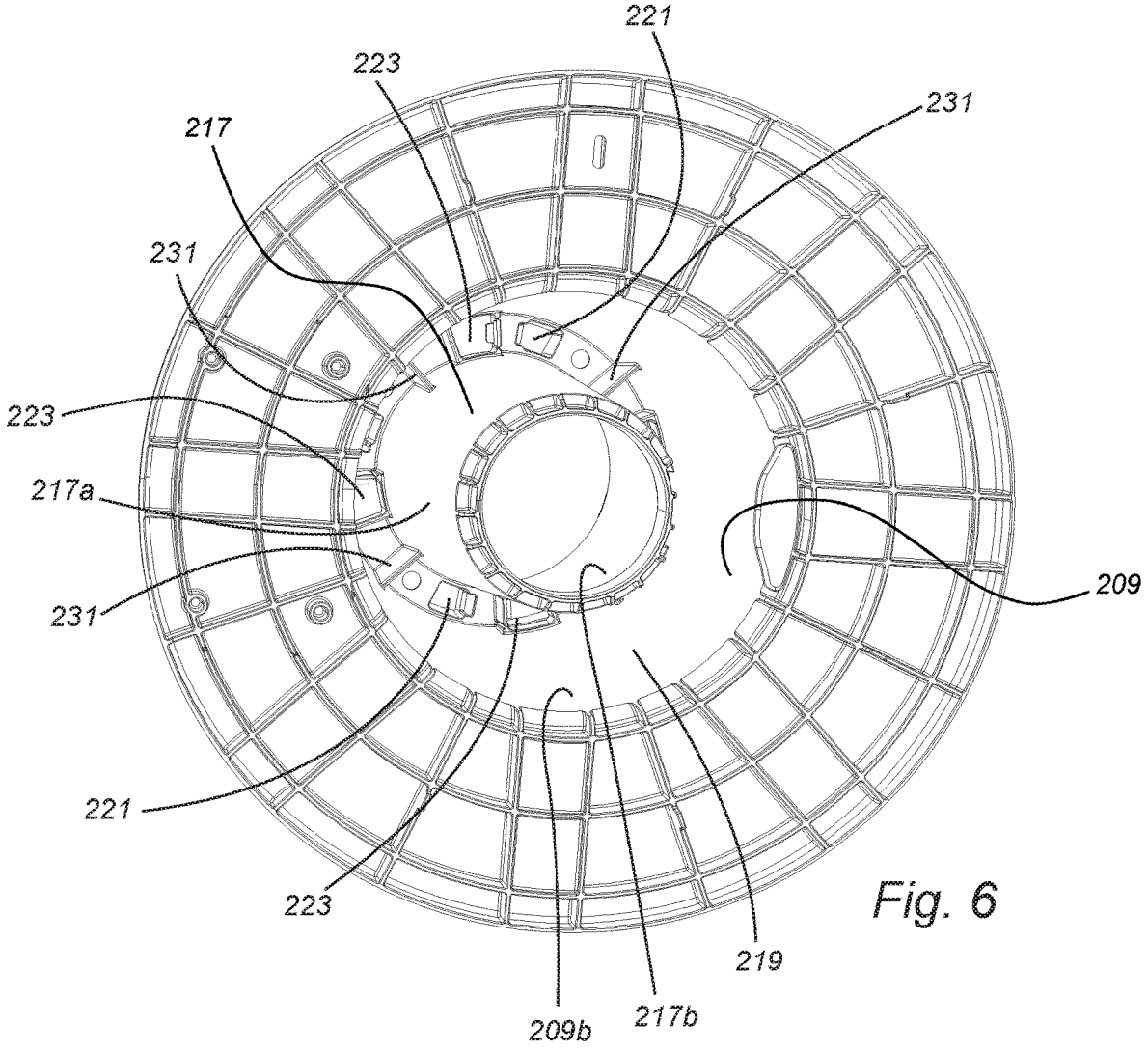
FIG. 6 is another perspective view of the stackable cable spool half of FIG. 5.

FIG. 6 is another perspective view of the stackable cable spool half 2 of FIG. 5. Shown herein are the recesses 223 receding into the interior core space 219 formed between the inner surface 209*b* of the core half outer wall 209 and the outer surface 217*a* of the core half inner wall 217. Furthermore, FIG. 6 shows the spacers 231 which are arranged in the interior core space 219 at a position adjacent to the first end 203 of the core half 201. The height of the spacers 231 is greater than the depth of the recesses 223 and the height of the protrusions 221. Thus, the protrusions 221 and the recesses 223 may be safely stowed away in a space formed by the spacers 231 of one cable spool half 2 abutting the annular end portion surface 211 of another cable spool half 2.

Figure 7:
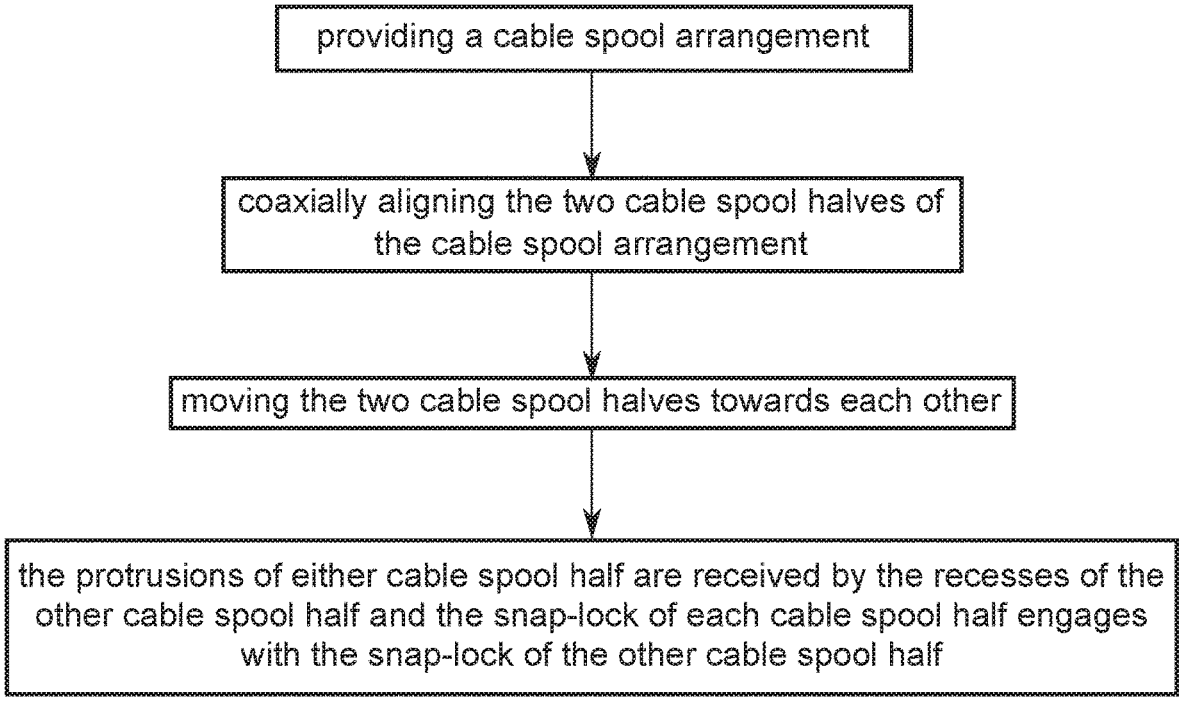
FIG. 7 is a schematic flow chart showing a method for connecting two cable spool core halves to each other.

FIG. 7 is a schematic flow-chart showing a method for connecting two cable spool halves 2 to each other. The method comprises the steps of:

- providing a cable spool arrangement 1 according to the first aspect of the present invention,
- coaxially aligning the two cable spool halves 2 of the cable spool arrangement 1 so that the protrusions 221 of one cable spool half 2 faces the recesses 223 of the other cable spool half 2,
- moving the two cable spool halves 2 towards each other, such that the protrusions 221 of either cable spool half 2 are received by the recesses 223 of the other cable spool half 2 and the snap-lock 227, 229 of each cable spool half 2 engages with the snap-lock 227, 229 of the other cable spool half 2.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. Furthermore, any reference signs in the claims should not be construed as limiting the scope.

The invention claimed is:

1. A cable spool arrangement for use in automated cable winding applications, said cable spool arrangement comprising:

a first core half and a second core half, each one of the first and second core halves comprising an outer wall having a conical section, wherein each one of said first core half and said second core half comprises a connecting arrangement configured to connect said first core half and said second core half together, and comprising at least one protrusion and at least one recess, wherein the protrusion of the connecting arrangement of said first core half is sized and dimensioned to mate with the corresponding recess of the connecting arrangement of said second core half to form a first protrusion-recess pair, and said recess of the connecting arrangement of said first core half is sized and dimensioned to mate with the corresponding protrusion of the connecting arrangement of said second core half to form a second protrusion-recess pair, and wherein said connecting arrangements comprises a snap-lock configured to axially lock said first core half to said second core half when the respective protrusion is received in the respective recess, wherein each one of said first core half and said second core half comprises an inner wall having an outer surface and wherein said outer wall has an inner surface, such that an interior core space is formed in each core half between said inner surface of said outer wall and said outer surface of said inner wall, wherein a spacer is arranged in said interior core space, said spacer being configured to prevent said first core half from wedging with said second core half during stacking of the first and second core halves.

2. A cable spool arrangement according to claim 1, wherein said connecting arrangements of said first and second core halves are configured to, by a single axial movement of the first core half towards the second core half, both rotationally and axially lock said first core half to said second core half.

3. A cable spool arrangement according to claim 1, wherein each one of the recesses of the connecting arrangements is sized and dimensioned to enclose the respective protrusion of the connecting arrangements, to enable rotational locking of the two core halves relative to each other.

4. A cable spool arrangement according to claim 1, wherein each one of said first core half and said second core half comprises a first end portion comprising said connecting arrangement, and a second end portion connectable to a cable spool flange, wherein said respective conical section tapers from said respective second end portion towards said respective first end portion.

5. A cable spool arrangement according to claim 4, wherein said first end portion of each one of said first core half and said second core half comprises an end portion surface from which said at least one protrusion is extending axially outwardly, and from which said at least one recess is extending axially inwardly.

6. A cable spool arrangement according to claim 1, wherein said snap-lock comprises male snap-lock parts and female snap-lock parts, and wherein each one of said first and second protrusion-recess pairs comprises a pair of at least one male snap-lock part and at least one female snap-lock part.

7. A cable spool arrangement according to claim 1, which is arrangeable in an assembled state in which the first core half is connected to said second core half by that said first and second protrusion-recess pairs are mating, and which is arrangeable in an unassembled state in which the first core half is separated from said second core half, and wherein said first core half and said second core half are, in said unassembled state, configured to be stackable, such that at least a part of said conical section of said first core half is received within said conical section of said second core half.

8. A cable spool arrangement according to claim 1, wherein the connecting arrangements of the first core half and the second core half are identical.

9. A stackable cable spool half comprising:

a first end portion comprising a connecting arrangement, a second end portion being connectable to a flange, a conical section arranged between said first and second end portions, wherein said connecting arrangement comprises at least one protrusion and at least one recess configured to connect said cable spool half to a corresponding connecting arrangement of another cable spool half, wherein the protrusion and the recess of the connecting arrangement are sized and dimensioned to mate with each other, and wherein said protrusion comprises one of a male snap-lock part and a female snap-lock part, and said recess comprises the other one of said male snap-lock part and female snap-lock part, said male and female snap-lock parts being sized and dimensioned to mate with each other, further comprising an inner wall having an outer surface and an outer wall having an inner surface, such that an interior core space is formed between said inner surface of said outer wall and said outer surface of said inner wall, wherein a spacer is arranged in said interior core space, said spacer being configured to prevent said cable spool half from wedging with another cable spool half during stacking of the cable spool half of the present invention and the other cable spool half.

10. A stackable cable spool half according to claim 9, wherein said first end portion comprises an end portion surface from which said at least one protrusion is extending axially outwardly, and from which said at least one recess is extending axially inwardly.

* * * * *